US006491551B1

(12) United States Patent
Julian et al.

(10) Patent No.: US 6,491,551 B1
(45) Date of Patent: Dec. 10, 2002

(54) ADJUSTABLE STUD FOR THROUGH THE WALL CONNECTORS

(75) Inventors: John K. Julian, Elmhurst, IL (US); Kenneth A. Julian, Oak Brook, IL (US)

(73) Assignee: Julian Electric Inc., Westmont, IL (US)

( * ) Notice: Subject to any disclaimer, the term of this patent is extended or adjusted under 35 U.S.C. 154(b) by 0 days.

(21) Appl. No.: 09/672,760

(22) Filed: Sep. 29, 2000

(51) Int. Cl.[7] ..... H01R 13/42

(52) U.S. Cl. ..... 439/737; 439/908; 439/801; 411/107; 411/384

(58) Field of Search ..... 439/737, 738, 439/739, 908, 801; 411/388, 389, 383, 384, 107

(56) References Cited

U.S. PATENT DOCUMENTS 1,391,633 A * 9/1921 Hazelton
1,728,786 A * 9/1929 Colby ..... 439/737
3,829,824 A * 8/1974 Pillischafske ..... 411/389
5,170,551 A * 12/1992 Norberg ..... 411/389
5,251,993 A * 10/1993 Sigourney ..... 411/384
5,639,268 A * 6/1997 Julian et al. ..... 439/908
6,116,833 A * 9/2000 Ellis ..... 411/384
6,419,279 B1 * 7/2002 Latham ..... 411/107

* cited by examiner

*Primary Examiner*—Tho D. Ta
(74) *Attorney, Agent, or Firm*—Patnaude & Videbeck

(57) ABSTRACT

Through-the-wall hot and ground type improved stud connectors are disclosed for use being positioned through heavy duty motor vehicle battery box sidewalls, engine fire walls, dashboards and the like. The stud connector including a connector housing of conductive material including a threaded bore axially therethrough. First and second flat annular lands defining opposing ends on the conductor housing. The annular outer surface on the connector housing extends from the first annular land to the second annular land. A portion of the outer surface adjacent the second flat annular land is threaded. The invention resides in a threaded stud member of predetermined length being threadedly engaged with the threaded bore axially through the connector housing for providing adjustable length threaded stud mountings on opposing ends of the connector housing.

4 Claims, 2 Drawing Sheets

ADJUSTABLE STUD FOR THROUGH THE WALL CONNECTORS

This invention relates generally to electrical connectors, and more particularly to electrical stud-type connectors having an adjustable and changeable length threaded stud together with its surrounding assembly which enables the connector to be mounted through apertures in battery box sidewalls, engine firewalls, dashboards and the like in modern trucks and other heavy duty motor vehicles.

BACKGROUND OF THE INVENTION

It is desirable to provide a readily accessible external source of 12 volt direct current voltage in heavy duty trucks and other large industrial and commercial motor vehicles. Such terminals may be either positive or negative terminals for providing jump start capability and for powering emergency light sources, running electric air compressors, powering auxiliary equipment and the like. Applicant's assignee is the owner of U.S. Pat. No. 5,639,628, issued Jun. 17, 1997 for through-the-wall connectors that provide a unitary electrically conductive stud member having overmolded insulative material positioned therearound to provide an electrically insulative barrier between the stud member and a battery box or other side wall aperture through which the connector is mounted. Additionally, a threaded or other type fastener may be mounted upon the opposing side of the firewall from the overmolded portion to secure that portion to the wall in either insulative or conductive fashion, as desired, and also provide for unfastening same and replacement thereof if necessary.

A need has arisen for a through-the-wall connector which is capable of expansion to meet additional 12 volt direct current power takeoff needs found in modern trucks and other heavy duty motor vehicles.

It is, therefore, an object of the present invention, generally stated, to provide a new and improved adjustable stud length through the wall stud type connector to provide adjustable length threaded stud portions on either side of a barrier wall through which the connector is mounted.

The simplicity, efficiency and utility of the through the wall connector disclosed in U.S. Pat. No. 5,639,268 has made it a very desirable connector for use in connection with trucks and other heavy duty motor vehicles to provide ready access to a 12 volt direct current power source. While such power sources when used with battery box side walls, engine firewalls, etc. are used on an infrequent or emergency basis, the through the wall connector, when used in connection with dashboard on a modern truck may be utilized to run auxiliary electric powered equipment on a constant basis, and for more than one application at a time.

In connection with multiple 12 volt power takeoffs connected to the through the wall connector at one time, the fixed length of the original threaded stud ends of the through the wall connector disclosed in U.S. Pat. No. 5,639,268 limits the number and size of electrical terminals that can be connected to either side of the connector. While a female ended terminal connection may be threaded onto either stud end of the original through the wall connector, such an extension eliminates the unitary member conductive aspect of the connector that provides most consistent electrical delivery from one end of the stud to the other.

SUMMARY OF THE INVENTION

The invention resides in an improved stud connector for mounting on a wall member. The stud connector comprises a connector housing of connective material including a threaded bore axially therethrough. The connector further includes first and second flat annular land means defining opposing ends of the connector housing. Each of the annular land means provides surface area electrical contact with any female conductive member mounted thereadjacent. An annular outer surface on the connector housing is positioned from the first flat annular land means to the second flat annular land means. The portion of an outer surface adjacent the second annular land means is threaded. The invention further includes a threaded stud member of predetermined length being threadedly engageable with the threaded bore axially through the connector housing for providing adjustable length threaded stud mountings on opposing ends of the connector housing.

BRIEF DESCRIPTION OF THE DRAWINGS

The features of the present invention, which are believed to be novel, are set forth with particularity in the appended claims. The invention may best be understood from the following detailed description of currently preferred embodiments thereof taken in conjunction with the accompanying drawings wherein like numerals refer to like parts, and in which:

DETAILED DESCRIPTION OF THE PREFERRED EMBODIMENT

Figure 3B:
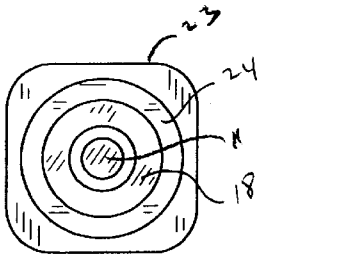
FIG. 3*b* is a right end elevational view of the adjustable connector shown in FIG. 2 without the attachable plastic nut.
Figure 3A:
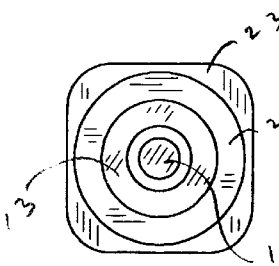
FIG. 3*a* is a left end elevational view of the adjustable through the wall connector shown in FIG. 2 without the attachable plastic nut thereon.
Figure 4B:
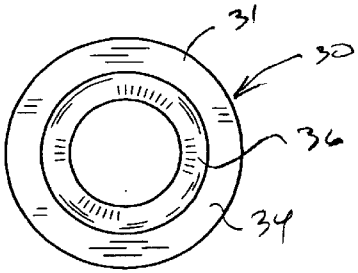
FIG. 4*b* is a left end elevational view of the plastic nut.
Figure 4A:
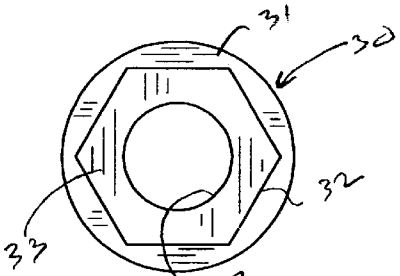
FIG. 4*a* is a right end elevational view of the plastic nut.
Figure 5:
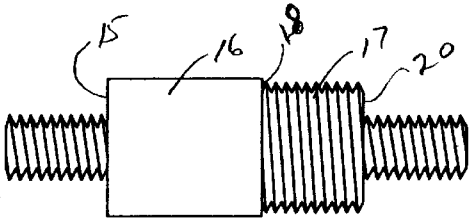
FIG. 5 is an elevational view of the intermediate metal portion and adjustable threaded stud portion of the adjustable through the wall connector.

Referring to FIGS. 1–5 the improved through-the-wall connector, generally indicated at 10, constructed in accordance with the present invention has at its heart a threaded stud member, generally indicated at 11. Stud member 18 is made in common diameters, i.e., ¼ inch, 5/16, ⅜, etc., and is fully threaded at 12 along its entire length. In the preferred connector embodiment 10, the threaded stud 12 is of a sufficient length to extend completely through the interior of the connector and have about ¾ inch of threads on either side thereof. In practice, an important aspect of the present invention is the capability of utilizing a common threaded stud member 11 of any length desirable to accommodate necessary connections to the connector 10, to be discussed in more detail below. In the preferred embodiment, the stud member 11 is made of a commercial steel, which is available not only in desired lengths as ordered from a manufacturer, but which is also has commercially available replacement stud members that may be obtained at hardware stores in any desired length necessary for possible modifications of the improved through-the-wall connector of the invention 10.

Radially outwardly of the stud bolt 11 is an annular, housing 13, preferably made of brass, that has an internally threaded through bore 14 which is complimentarily threaded to the threads 12 of stud bolt 11 so as to allow the stud bolt to be mounted therein and threadedly axially moved along bore 14 to any desired mounted position therein. The outside of the annular brass housing 13 includes a flat annular left face or land 15 extending from the left end of the threaded bore 14 to the outer perimeter of the housing. Adjacent the left had annular face or land 15 is a round knurled outer surface 16, the purpose of the knurled surface will be discussed below. Adjacent the right hand end of the outer knurled surface 16 is an intermediate annular land 18, and thereadjacent is an outer threaded surface 17 which extends from the intermediate land 18 to a flat right hand annular face or land 20 whose inside edge is in communication with the right hand end of the threaded through bore 14.

Positioned on the outside of the rounded knurled surface 16 is an overmolded plastic member, generally indicated at 21. The overmolded plastic member 21 is retained on the knurled outer portion 16 by the being molded into and around the knurled surfaces. Overmolded portion 21 is made of a plastic insulative material and includes an annular body portion 22 having a rectangular flange 23 extending outwardly of a central portion thereof. The right hand end of rectangular overmolded portion 21 includes an extension 24 of the plastic body portion 22 which is sized externally to fit snugly into an aperture 25 through a battery box side wall, fire wall, heavy duty vehicle dashboard or the like 26.

Referring to FIGS. 1, 2, 4*a* and 4*b*, an insulative nut, generally indicated at 30, includes a round outer flange portion 31, a hexagonal nut body portion 32 thereadjacent and an outer flat face 33. On the inside of the nut on the outer flange portion, an annular flat face 34 is sized to be positioned against the fire wall or other wall 26 and it includes an inner axially extending cylindrical wall 35 which has a diameter sized to be complementary mateable to the outside of the body extension 24 of the plastic overmolded portion 21 of the brass housing 13 as is most clearly shown in FIG. 1. A radially extending annular face 36 extends from the face 35 previously mentioned to a threaded internal bore 37 and is sized to complement the intermediate land 18 and the overmolded extension of the body 22 positioned radially outwardly thereof to form a tight fit when the nut 30 is turned on the threads 17 of the housing 13 until the flat annular faces 34 and 36, respectively, engage the fire wall 26 and intermediate face 18 simultaneously as the nut 30 is screwed onto the threads 17.

Figure 1:
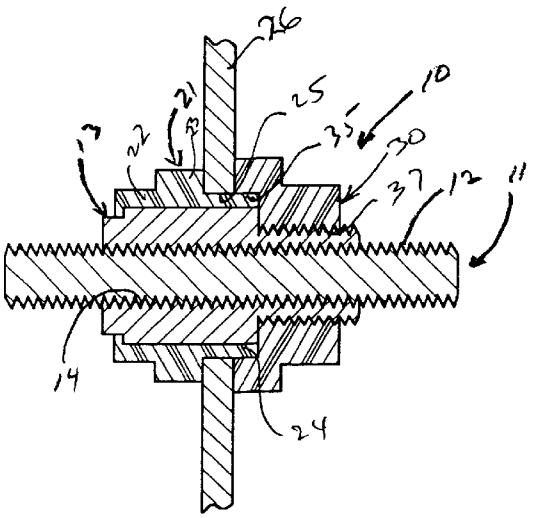
FIG. 1 is an elevational view of the adjustable through the wall stud connector constructed in accordance with the present invention, as it appears mounted through an aperture in a wall panel.
Figure 2:
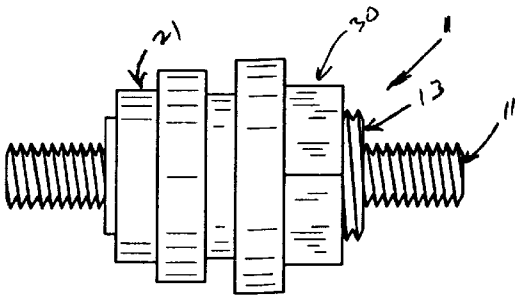
FIG. 2 is an elevational view of the adjustable through the wall connector shown in FIG. 1 as it appears in unmounted by complete condition.

With the improved through-the-wall connector mounting in place, as shown in FIG. 1, the threaded stud 11 may be threaded to the right or left depending upon the amount of threads needed on either side of the connector to accomplish the number and size of connections to be made, as desired by a user. Additionally, if a longer stud 11 is needed, one may be obtained at a local hardware store and may be sized to any desired length.

Stud 11 may be made of any electrically conductive material, preferably steel or brass. When a female electrical connector is positioned around one end of the stud 11. It is preferably positioned in facial surface contact with either face 15 or 20 of the annular housing for uninterrupted primary electrical flow therethrough. Secondary electrical flow is conducted through the stud 11. The use of female nut fasteners (not shown) to anchor the female electrical connectors to the faces 15 or 20 also provides a lock nut capability to maintain the stud 11 in its proper position. Also if a fixed structure is desired, the stud 11 and housing 13 may be plated with a metal (preferably cadmium) to form a unitary conductive structure.

Figure 7B:
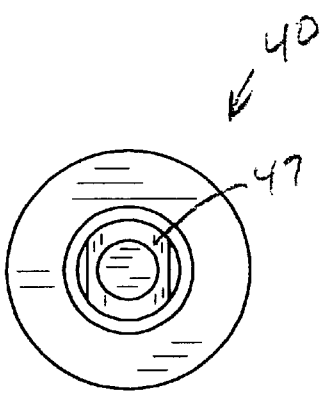
FIG. 7*b* is a right end elevational view of the connector of the second embodiment without a nut threaded thereon.
Figure 7A:
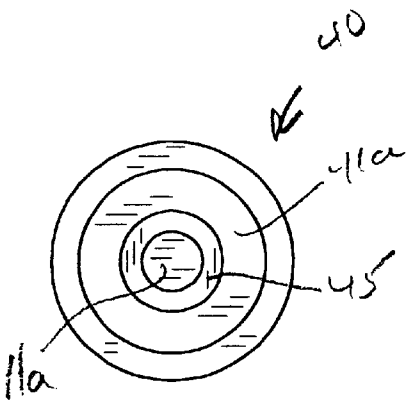
FIG. 7*a* is a left end elevational view of the adjustable connector of the second embodiment without a nut threaded thereon.
Figure 6:
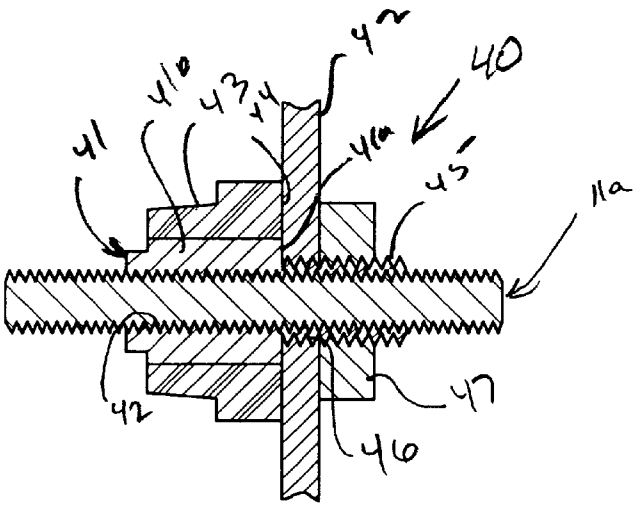
FIG. 6 is an elevational sectional view of a second embodiment of the present invention utilized for ground or negative terminal connections.

Referring to FIGS. 6–7*b*, a second embodiment of the present invention, generally indicated at 40, includes the threaded stud 11*a* which is adjustably mounted in an annular brass housing 41, and has a threaded bore 42 positioned therethrough for receiving the threaded stud 11*a*. The second embodiment 40 of the present invention is utilized as an improved through-the-wall connector for ground or negative pole uses. This connector takes a ground wire and sends the current to the fire wall 42 to complete the circuitry. The outside of the housing 41, preferably made of brass, includes an overmolded plastic insulated portion 43 which may have almost any shape, round, hexagonal, etc., as long as it has a flat face 44 forming an extension of an intermediate face or land 41*a* of the brass housing being an intermediate part of a body portion 41*b*. The remainder of the brass housing 41 includes a threaded annular portion 45 which extends through an aperture 46 in fire wall 42. Preferably, the aperture 46 is threaded to accept the threads 45. The size and thread structure 45 of the threaded portion is, preferably, a standard configuration adapted to receive a nut 47 which retains the improved through-the-wall connector onto the fire wall 42 in electrical communication therewith. As with the first embodiment, the stud 11*a* may be plated to the housing to provide a unitary fixed structure, if so desired.

Thus, an improvement in two embodiments of an improved through-the-wall connector has been shown and described which allows adjustment of the threaded connector stud in the connector portion thereof to provide versatility in mounting various electrical connections thereto.

While two embodiments of the present invention have been shown and described, it will be understood by those skilled in the art that changes and modifications may be made without departing from the invention in its broader aspects. Therefore, it is aim of the appended claims to cover all such changes and modifications as fall within the true spirit and scope of the present invention.

What is claimed:

1. An improved stud connector for mounting on a wall member, said stud connector comprising:

a connector housing of conductive material including a threaded bore axially therethrough, first and second flat annular land means defining opposing ends on said connector housing, each said annular land means for providing surface area electrical contact with any female conductive members mounted thereadjacent, an annular outer surface on said connector housing from said first flat annular land means to said second flat annular land means, a portion of said outer surface adjacent said second flat annular land means being threaded, and a threaded stud member of predetermined length being threadedly engageable with said threaded bore axially through said connector housing for providing adjustable length threaded stud mountings on opposing ends of said connector housing.

2. The improved stud connector as called for in claim 1 wherein, a joinder of said annular outer surface and said threaded portion thereof include a third flat annular land for surface electrically conductive engagement with one surface of any wall member through which said stud connector is mounted.

3. The improved stud connector as called for in claim 1 further including, an insulative member around a portion of said outer surface adjacent said first flat annular land, said insulative member including a radial flange for abutting one side of a wall member and an annular flange for extending through an aperture in any wall member.

4. An improved stud connector for mounting on a wall member, said stud connector comprising, a a connector housing of conductive material including a threaded bore axially therethrough, first and second flat annular land means defining opposing ends on said connector housing, each said annular land means for providing surface area electrical contact with any female conductive members mounted thereadjacent, an annular outer surface of said connector housing extending from said first flat annular land means to said second flat annular land means, an insulative member around a first portion of said outer surface, said insulative member including a radial flange for abutting one side of a wall member, and an annular flange for extending through an aperture in any wall member, a second portion of said outer surface externally of said insulative member being threaded, a wall mounting nut including a threaded aperture therethrough for matingly engaging said threaded second portion of said housing outer surface, and an outer flange for abutting an opposing side of a wall member, an annular recess between said outer flange and said threaded aperture for slidably adjustably receiving said annular flange on said insulative members for mounting same through walls of differing thicknesses, and a threaded stud member of predetermined length being threadedly engageable with said threaded bore axially through said connection housing for providing adjustable length threaded stud mountings on opposing ends of said connector housing.

* * * * *